US005521347A

United States Patent [19]

Imaeda et al.

[11] Patent Number: 5,521,347

[45] Date of Patent: May 28, 1996

[54] SWITCH DEVICE

[75] Inventors: Satoru Imaeda; Hitoshi Taguchi; Yoshinobu Sugiyama, all of Aichi, Japan

[73] Assignee: Kabushiki Kaisha Tokai Rika Denki Seisakusho, Aichi, Japan

[21] Appl. No.: 346,245

[22] Filed: Nov. 23, 1994

[30] Foreign Application Priority Data

Nov. 25, 1993 [JP] Japan ..... 5-063220 U

[51] Int. Cl.[6] ..... H01H 13/42

[52] U.S. Cl. ..... 200/525; 200/529

[58] Field of Search ..... 200/529, 523, 200/525, 520, 553, 558, 556, 521, 522, 533

[56] References Cited

U.S. PATENT DOCUMENTS

| | | | |
|---|---|---|---|
| 3,502,833 | 3/1970 | Rossini et al. | 200/525 |
| 3,789,173 | 1/1974 | Bury | 200/525 |
| 4,473,728 | 9/1984 | Sketch | 200/525 |

*Primary Examiner*—David J. Walczak

*Attorney, Agent, or Firm*—Finnegan, Henderson, Farabow, Garrett & Dunner

[57] ABSTRACT

A switch device includes an automatic return type operating piece depressed to move and automatically returned to an original position, a swinging member swingably mounted on a shaft, the swinging member being swung in opposite directions alternately whenever depressed by the operating piece, an articulation piece provided at the end portion of the swinging member in such a manner that the articulation piece is urged towards the front end thereof, and a V-shaped articulation member having a top and two slopes, functioning to hold the swinging member at one of two swing positions with the articulation piece abutted against one of the two slopes, and to hold the swinging member at the other swing position with the articulation piece abutted against the other slope so as to achieve, a switching operation, wherein two member selected from the group consisting of the push rod, the center of rotation of the swinging member, and the top of the V-shaped articulation member are arranged on one and the same straight line, and a remaining member is shifted slightly from the straight line.

3 Claims, 3 Drawing Sheets

SWITCH DEVICE

BACKGROUND OF THE INVENTION

1. Field of the Invention

This invention relates to a switch device which is suitably applicable as, for instance, a dimmer switch device of one position type for a motor vehicle.

2. Related Art

An example of a dimmer switch device of one position type for a motor vehicle has been disclosed by Unexamined Japanese Utility Patent Application No. 27931/1989. The dimmer switch device is designed as shown in FIG. 4. That is, an operating member 2 is provided on a switch body 1 in such a manner that it is vertically movable and is urged upwardly by a coil spring 3 interposed between the switch body 1 and the operating member 2. An operating piece, namely, a push rod 4 is provided at the center of the lower surface of the operating member 2. The push rod 4 is moved along a straight line A together with the operating member 2. When the operating member 2 is pushed from above by an operating lever 5, the operating member 2 is moved downwardly; and when the operating lever 5 is released, the operating member 2 is returned to its original position (as shown in FIG. 4) by the elastic force of the coil spring 3. More specifically, the push rod 4 is also returned to its original position together with the operating member 2. That is, the push rod 4 is an automatic return type operating piece.

Below the push rod 4, a swinging member, namely, a dimmer cam 6 is swingably mounted on a shaft 7. An accommodating chamber **6*a* is formed in the lower end portion of the dimmer cam 6, in which an articulation piece 8 is accommodated. The articulation piece 8 is urged outwardly by a coil spring 9 interposed between the bottom of the accommodating chamber 6*a* and the articulation piece 8. Below the dimmer cam 6, a V-shaped articulation member 10 is provided with which the articulation piece 8 is in contact. The V-shaped articulation member 10 has a top 10*a* and two slopes 10*b* and 10*c***.

When the lower end of the articulation piece 8 abuts against the right slope **10*b* of the V-shaped articulation member 10 while the right end portion 6*b* of the dimmer cam 6 engages with a regulating part of the switch body 1, the dimmer cam 6 takes a first swing position as shown in FIG. 4. When, under this condition, the operating member 2 together with the push rod 4 is depressed by the operating lever 5, the lower end portion of the push rod 4 is abutted against the upper right slope and right recess 6*c* of the dimmer cam 6 to push the latter 6. As a result, the dimmer cam 6 is turned (swung) clockwise (in FIG. 4) about the shaft 7; that is, the lower end portion of the articulation piece 8 is moved over the top 10*a* of the V-shaped articulation member 10, and brought into contact with the left slope 10*c* of the latter 10 while the upper left portion 6*d* of the dimmer cam 6 is engaged with another regulating part of the switch body 1. Thus, the dimmer cam 6 is held at a second swing position which is located symmetrical with the first swing position shown in FIG. 4**.

When, under the condition that the dimmer cam 6 is held at the second swing position, the operating member 2 together with the push rod 4 is depressed by the operating rod 5, the lower end of the push rod 4 is abutted against the upper left slope and left recess **6*e* of the dimmer cam 6 to push the latter 6. As a result, the dimmer cam 6 is swung in the opposite direction (counterclockwise) to the first swing position. That is, the dimmer cam 6 takes the first and second swing positions alternately whenever pushed by the push rod 4**.

A dimmer change-over switch operating in association with the swing of the dimmer cam 6 is designed as follows: When the dimmer cam 6 is at the first swing position, the contact mechanism operates to select a high beam is obtained; and when the dimmer cam 6 is at the second swing position, the contact mechanism operates to select a low beam. That is, whenever the operating lever 5 is operated by the operator; in other words, whenever the operating member 2 together with the push rod 4 is depressed, the dimmer change-over switch is operated to switch the high beam and the low beam over to each other.

In the above-described conventional switch device, as shown in FIG. 4, the push rod 4, the axis of the shaft 7 of the dimmer cam 6, and the top **10*a* of the V-shaped articulation member 10 are on one and the same straight line A. Hence, depending on the way of operation of the operating lever 5, as shown in FIG. 5 the lower end of the articulation piece 8 of the dimmer cam 6 is set on the top 10*a* of the V-shaped articulation member 10; that is, the dimmer cam 6 is stopped at the neutral position. Even if, in this case, the operating lever 5 is operated to push the operating member 2 and the push rod 4 downwardly, the dimmer cam 6 may be held at the neutral position, because the lower end of the push rod 4 merely abuts against the top 6*f* of the dimmer cam 6, to push the latter. Hence, in this case, in order to swing the dimmer cam 6 to the first or second swing position, it is necessary to operate the operating lever 5** repeatedly.

SUMMARY OF THE INVENTION

In view of the foregoing, an object of the invention is to provide a switch device in which the swinging member is positively prevented from being stopped at the neutral position, and even if it is stopped at the neutral position, it can be swung to any one of the two swing positions with ease.

The foregoing object of the invention has been achieved by the provision of a switch device comprising: an automatic return type operating piece which is depressed to move, and is automatically returned to the original position; a swinging member swingably mounted on a shaft, the swinging member being swung in opposite directions alternately whenever depressed by the operating piece; an articulation piece provided at the front end portion of the swinging member in such a manner that the articulation piece is urged towards the front end thereof; and a V-shaped articulation member having a top and two slopes, functioning to hold the swinging member at one of two swing positions with the articulation piece abutted against one of the two slopes, and to hold the swinging member at the other swing position with the articulation piece abutted against the other slope, wherein two selected from the group consisting of the push rod, the center of rotation of the dimmer cam, and the top of the V-shaped articulation member are arranged on one and the same straight line, and the remaining one is shifted slightly from the straight line.

In the switch device of the invention, two selected from the group consisting of the push rod, the center of rotation of the dimmer cam, and the top of the V-shaped articulation member are arranged on one and the same straight line, and the remaining is shifted slightly from the straight line. For instance in the case where the operating piece and the center of rotation of the swinging member are arranged on one and the same straight line, and the top of the V-shaped articulation member is shifted slightly from the straight line, the switch device is free from the difficulty that the articulation piece of the swinging member is held stopped at the top of the V-shaped articulation member, or the swinging member is locked at the neutral position. In the case where the center of rotation of the swinging member, and the top of the V-shaped articulation member are arranged on one and the same straight line, and the operating piece is shifted slightly from the straight line, the switch device has the following merit: even if the articulation piece of the swinging member is stopped at the top of the V-shaped articulation member, the swinging member can be readily swung to one of the two swing positions by depressing the operating piece only once.

DETAILED DESCRIPTION OF THE PREFERRED EMBODIMENTS

Figure 4:
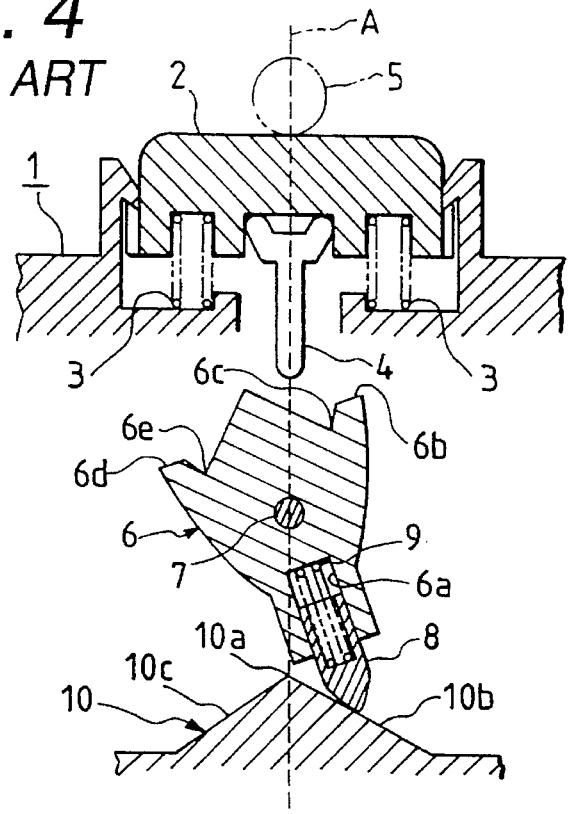
FIG. 4 PRIOR ART
FIG. 4 is a vertical sectional view showing a conventional dimmer switch device.
Figure 5:
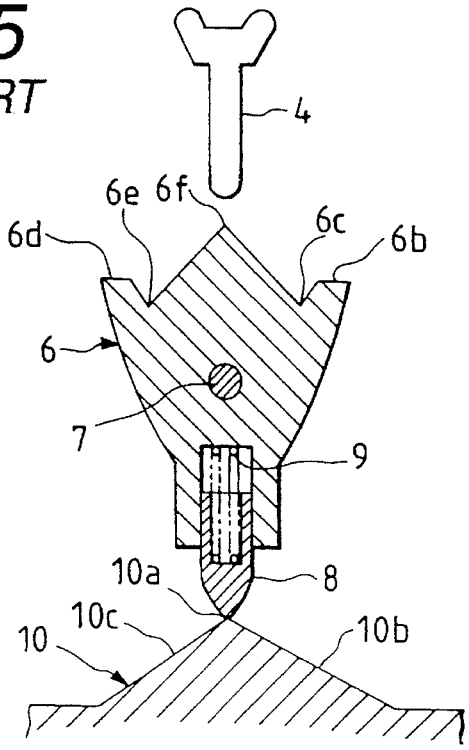
FIG. 5 PRIOR ART
FIG. 5 is a vertical section view showing a dimmer cam stopped at the neutral position in the dimmer switch device.

A dimmer switch device of one position type for a motor vehicle, which constitutes a first embodiment of the invention, will be described with reference to FIG. 1, in which parts corresponding functionally to those which have been described with reference to FIG. 4 are therefore designated by the same reference numerals or characters.

Figure 1:
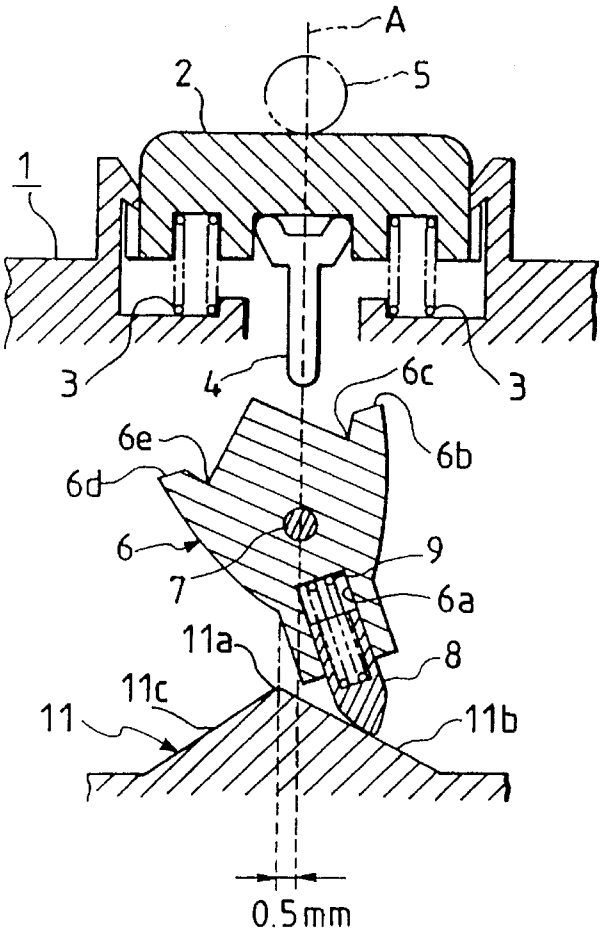
FIG. 1 is a vertical sectional view showing an example of a dimmer switch device, which constitutes a first embodiment of the invention.

As shown in FIG. 1, an operating member 2 is provided on a switch body 1 in such a manner that it is vertically movable and is urged upwardly by a coil spring 3. An automatic return type operating piece, namely, a push rod 4 is provided at the center of the lower surface of the operating member 2. The push rod 4 together with the operating member 2 is moved along a straight line A.

An operating lever 5, which is operated by the operator, is provided on the operating member 2. When the operating lever 5 is moved downwardly, the operating member 2 is pushed downwardly; and when it is released, the operating member 2 is returned to its original position as shown in FIG. 1. Below the push rod 4, a swinging member, namely, a dimmer cam 6 is swingably mounted on a shaft 7. The center of rotation of the dimmer cam 6; i.e., the central axis of the shaft 7, and the push rod 4 are arranged on the straight line A. An accommodating chamber 6*a* is formed in the lower end portion of the dimmer cam 6. An articulation piece 8 is slidably accommodated in the accommodating chamber, and is urged towards its end (downwardly) by a coil spring 9.

Below the dimmer cam 6, a V-shaped articulation member 11 is provided with which the articulation piece is in contact. The V-shaped articulation member 11 has a top 11*a* and two slopes 11*b* and 11*c*. The top 11*a* is shifted slightly from the straight line A (for instance, shifted about 0.5 mm to the left of the straight line A).

When the lower end of the articulation piece 8 abuts against the right slope 11*b* of the V-shaped articulation member 11 while the right end portion 6*b* of the dimmer cam 6 engages with a regulating part (not shown) of the switch body 1, the dimmer cam 6 takes a first swing position as shown in FIG. 1. When, under this condition, the operating member 2 together with the push rod 4 is depressed by the operating lever 5, the lower end portion of the push rod 4 is abutted against the upper right slope and right recess 6*c* of the dimmer cam 6 to push the latter 6. As a result, the dimmer cam 6 is swung clockwise (in FIG. 1) about the shaft 7; that is, the lower end portion of the articulation piece 8 is moved over the top 11*a* of the V-shaped articulation member 11, and brought into contact with the left slope 11*c* of the latter 11 while the upper left portion 6*d* of the dimmer cam 6 is engaged with another regulating part (not shown) of the switch body 1. Thus, the dimmer cam 6 is held at a second swing position which is located symmetrical with the first swing position shown in FIG. 1.

Similarly, when, under the condition that the dimmer cam 6 is held at the second swing position, the operating member 2 together with the push rod 4 is depressed by the operating rod 5, then the lower end of the push rod 4 is abutted against the upper left slope and left recess 6*e* of the dimmer cam 6 to push the latter 6. As a result, the dimmer cam 6 is swung in the opposite direction (counterclockwise) to the first swing position.

A dimmer change-over switch (not shown) is provided in the switch body 1 so as to operate in association with the swing of the dinner cam 6. More specifically, the dimmer change-over switch is so designed that, when the dimmer cam 6 is at the first swing position, its contact mechanism operates to select a high beam; and when the dimmer cam 6 is at the second swing position, its operates to select a low beam.

As was described above, in the embodiment of the invention, as shown in FIG. 1 the center of rotation of the dimmer cam 6 (the central axis of the shaft 7) and the pushed rod 4 are arranged on one and the same straight line A, and the top 11*a* of the V-shaped articulation member 11 is shifted slightly from the straight line A (for instance about 0.5 mm to the left). Hence, the articulation piece 8 of the dimmer cam 6 will never be stopped at the top 11*a* of the V-shaped articulation member 11. That is, the dimmer cam 6 is positively prevented from being held locked at the neutral position.

Figure 2:
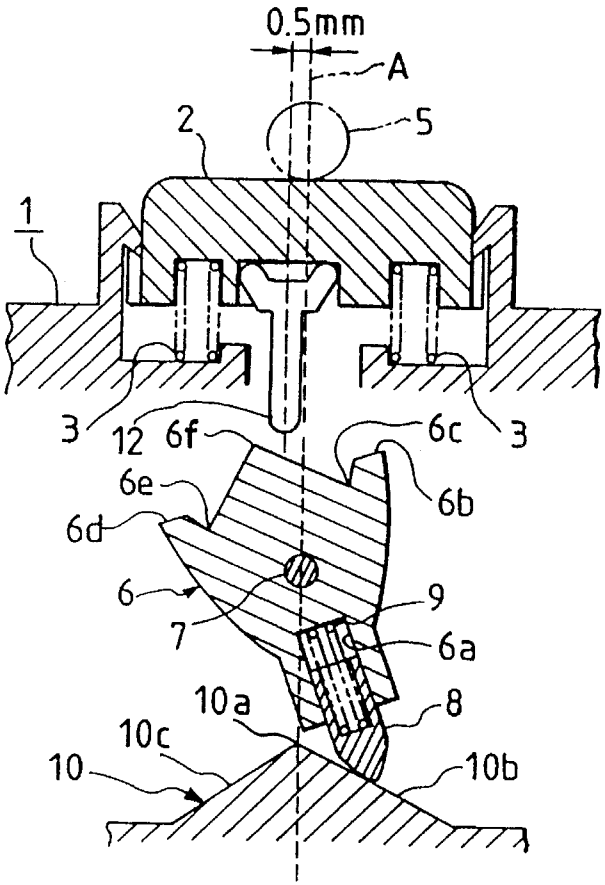
FIG. 2 is a vertical sectional view showing another example of the dimmer switch device, which constitutes a second embodiment of the invention.

FIG. 2 shows a second embodiment of the invention. The second embodiment is different from the first embodiment as follows: In FIG. 2, parts corresponding functionally to those which have been described with reference to the first embodiment shown in FIG. 1 and the conventional switch device shown in FIG. 4 are therefore designated by the same reference numerals or characters. As shown in FIG. 2, the center of rotation of the dimmer cam 6 and the top 10*a* of the V-shaped articulation member 10 are arranged on the straight line A, and a push rod 12, which is an operating piece, is shifted slightly from the straight line A (for instance, shifted about 0.5 mm to the left). Hence, even if the articulation piece 8 of the dimmer cam 6 is stopped at the top 10*a* of the V-shaped articulation member 10 depending on the way of operation of the operating lever 5, the dimmer cam 6 can be readily swung to one of the two swing positions by depressing the push rod with the operating lever 5. Thus, the switch device of the invention, unlike the conventional switch device, is free from the difficulty that the dimmer cam 6 is stopped at the neutral, and it is necessary to operate the operating lever 5 repeatedly.

Figure 3:
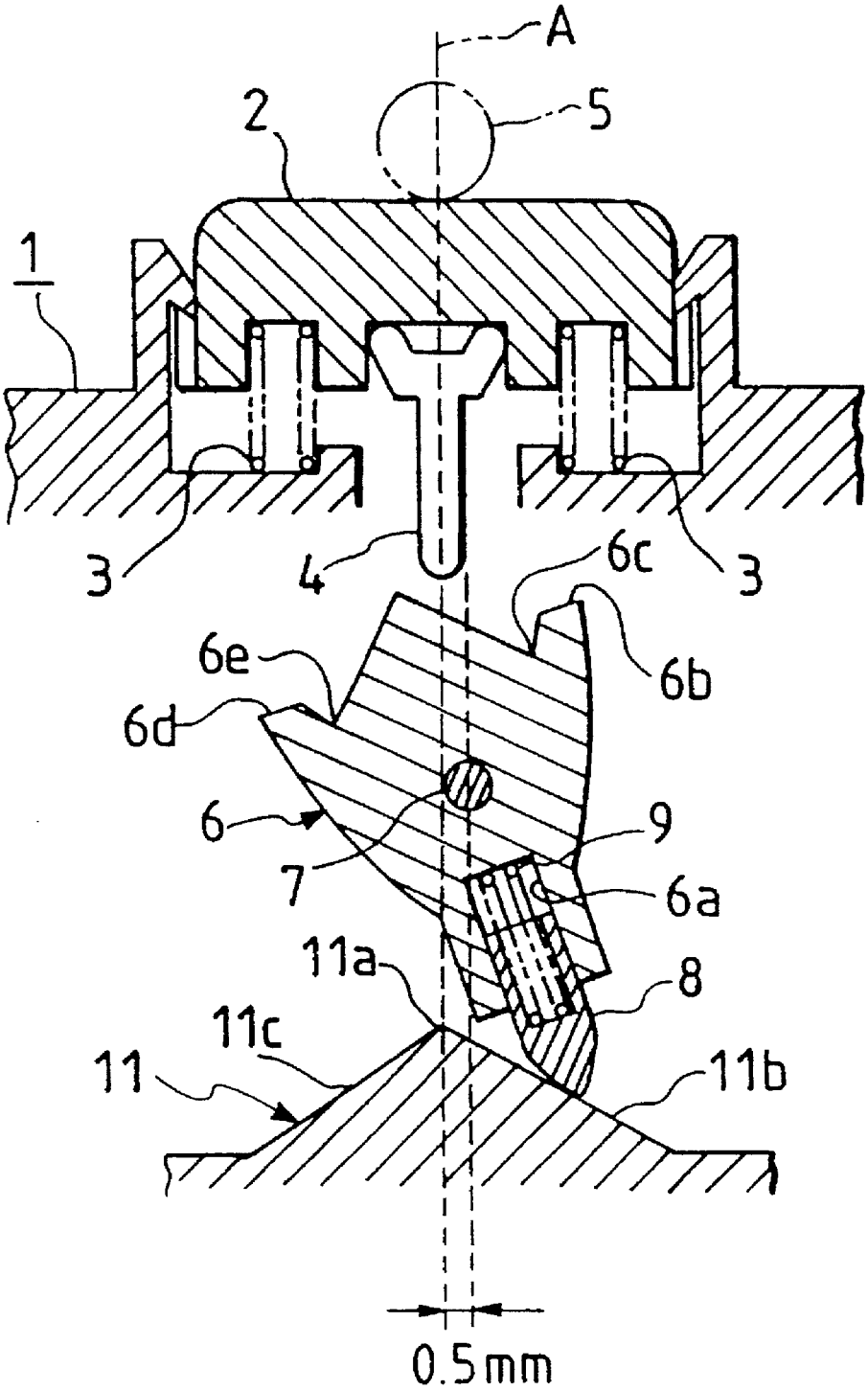
FIG. 3 is a vertical sectional view showing a third example of the dimmer switch, which constitutes a third embodiment of the invention.

In the above-described first embodiment, the center of rotation of the dimmer cam 6, and the push rod 4 are arranged on the straight line A, and the top 11*a* of the V-shaped articulation member 11 is shifted slightly from the straight line A; whereas in the second embodiment, the center of rotation of the dimmer cam 6 and the top 10*a* of the V-shaped articulation member 10 are arranged on the straight line A, and the push rod 12 is shifted slightly from the straight line A; however, the invention is not limited thereto or thereby. For instance, as shown in FIG. 3, the push rod and the top of the V-shaped articulation member may be arranged on one and the same straight line, with the center of rotation of the dimmer cam shifted slightly from the straight line. If summarized, in the switch device of the invention, two selected from the group consisting of the push rod, the center of rotation of the dimmer cam, and the top of the V-shaped are arranged on one and the same straight line, and the remaining one is shifted slightly from the straight line.

In the switch device of the invention, two selected from the group consisting of the push rod, the center of rotation of the dimmer cam, and the top of the V-shaped articulation member are arranged on one and the same straight line, and the remaining is shifted slightly from the straight line.

Hence, the swinging member is positively prevented from being stopped at the neutral position. Even if the swinging member is stopped at the neutral position, it can be readily swung to one of the two swing positions. This effect should be highly appreciated in practical use.

What is claimed is:

1. A switch device comprising:

an automatic return-type operating piece depressed to move and automatically returned to an original position;

a swinging member swingably mounted on a shaft;

a push rod actuable by said operating piece, having a first position when said operating piece is in the original position and a second position in which the push rod is in contact with the swinging member when said operating piece is depressed thereby swinging alternately the swinging member in opposite directions; and a V-shaped articulation member having a top and two slopes, functioning to hold the swinging member at one of two swing positions so as to achieve a switching operation, wherein the shaft and the top of the V-shaped articulation member are arranged on one and the same straight line, and the push rod is offset from the straight line when it is in the first position.

2. A switch device comprising:

an automatic return-type operating piece depressed to move and automatically returned to an original position;

a push rod which is actuated by the operating piece;

a swinging member swingably mounted on a shaft having a fixed center of rotation, the swinging member being swung in opposite directions alternately by said push rod when said push rod is actuated by the operating piece; and a V-shaped articulation member having a top and two slopes, functioning to hold the swinging member at one of two swing positions so as to achieve a switching operation, wherein the push rod and the top of the V-shaped articulation member are arranged on one and the same straight line, and the shaft is offset from the straight line.

3. A switch device comprising:

an automatic return-type operating piece depressed to move and automatically returned to an original position;

a push rod which is actuated by said operating piece;

a swinging member swingably mounted on a shaft, the swinging member being swung in opposite directions alternately by said push rod when said push rod is actuated by the operating piece; and a V-shaped articulation member having a top and two slopes, functioning to hold the swinging member at one of two swing positions so as to achieve a switching operation, wherein the push rod and the shaft are arranged on one and the same straight line, and the top of the V-shaped articulation member is shifted slightly from the straight line.

* * * * *